US008506038B2

(12) United States Patent
Mizes et al.

(10) Patent No.: US 8,506,038 B2
(45) Date of Patent: Aug. 13, 2013

(54) METHOD AND SYSTEM FOR ALIGNING PRINTHEADS THAT EJECT CLEAR INK IN AN INKJET PRINTER

(75) Inventors: Howard A. Mizes, Pittsford, NY (US); David A. Mantell, Rochester, NY (US); Joseph C. Sheflin, Macedon, NY (US); Michael C. Mongeon, Walworth, NY (US); Michael J. Levy, Webster, NY (US); Charles D. Rizzolo, Fairport, NY (US); Jeffrey J. Folkins, Rochester, MA (US)

(73) Assignee: Xerox Corporation, Norwalk, CT (US)

( * ) Notice: Subject to any disclaimer, the term of this patent is extended or adjusted under 35 U.S.C. 154(b) by 108 days.

(21) Appl. No.: 13/184,638

(22) Filed: Jul. 18, 2011

(65) Prior Publication Data

US 2013/0021398 A1 Jan. 24, 2013

(51) Int. Cl.
*B41J 2/05* (2006.01)

(52) U.S. Cl.
USPC ..... 347/19; 347/15; 347/42

(58) Field of Classification Search
USPC ..... 347/5, 9, 13, 19, 42, 15
See application file for complete search history.

(56) References Cited

U.S. PATENT DOCUMENTS

| | | | | |
|---|---|---|---|---|
| 5,398,131 | A | 3/1995 | Hall et al. | |
| 5,898,443 | A * | 4/1999 | Yoshino et al. | 347/19 |
| 6,267,052 | B1 | 7/2001 | Hill et al. | |
| 6,378,976 | B1 | 4/2002 | Byers et al. | |
| 6,454,383 | B2 | 9/2002 | Lund et al. | |
| 6,554,398 | B2 * | 4/2003 | Wyngaert et al. | 347/42 |
| 6,899,775 | B2 | 5/2005 | Hill et al. | |
| 6,994,413 | B2 | 2/2006 | Otsuka et al. | |
| 7,101,017 | B2 | 9/2006 | Endo et al. | |
| 7,113,615 | B2 | 9/2006 | Rhoads et al. | |
| 7,533,982 | B2 | 5/2009 | Yoneyama | |
| 7,621,614 | B2 | 11/2009 | Endo | |
| 7,690,746 | B2 | 4/2010 | Mantell et al. | |
| 2004/0258274 | A1 | 12/2004 | Brundage et al. | |
| 2006/0249039 | A1 | 11/2006 | Feldman et al. | |
| 2008/0211866 | A1 | 9/2008 | Hill | |
| 2009/0220750 | A1 | 9/2009 | Hill et al. | |
| 2009/0237434 | A1 | 9/2009 | Mantell et al. | |
| 2009/0267975 | A1 | 10/2009 | White et al. | |
| 2010/0112223 | A1 | 5/2010 | Hill | |

* cited by examiner

*Primary Examiner* — Lam S Nguyen
(74) *Attorney, Agent, or Firm* — Maginot, Moore & Beck, LLP

(57) ABSTRACT

A method enables an operator to detect misalignment of printheads that eject clear ink in an inkjet printer. The method prints a first test pattern with a first color of ink and then prints a second test pattern of clear ink on top of the first test pattern. The ink of the first and the second test patterns is then spread to enable the clear ink to be dispersed in interstitial spaces in the ink of the first color. An operator is then able to detect the spatial relationship of predetermined marks in the second test pattern to predetermined marks in the first test pattern. The predetermined marks of the first and the second test patterns are arranged to enable an operator to detect a misalignment distance and the inkjet printer uses the misalignment distance entered by the operator to adjust the alignment of the printheads that eject clear ink.

21 Claims, 8 Drawing Sheets

METHOD AND SYSTEM FOR ALIGNING PRINTHEADS THAT EJECT CLEAR INK IN AN INKJET PRINTER

TECHNICAL FIELD

The system and method disclosed in this document relates to inkjet printing systems generally, and, more particularly, to systems and method for aligning printheads to enable ink drop registration in the inkjet printing system.

BACKGROUND

Ink jet printers have printheads that operate a plurality of inkjets that eject liquid ink onto an image receiving member. The ink may be stored in reservoirs located within cartridges installed in the printer. Such ink may be aqueous, oil, solvent-based, or UV curable ink or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, or voltage level, of the signals affects the amount of ink ejected in each drop. The firing signal is generated by a printhead controller in accordance with image data. An inkjet printer forms a printed image in accordance with the image data by printing a pattern of individual ink drops at particular locations on the image receiving member. The locations where the ink drops landed are sometimes called "ink drop locations," "ink drop positions," or "pixels." Thus, a printing operation can be viewed as the placement of ink drops on an image receiving member in accordance with image data.

In order for the printed images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer.

Systems and method exist for detecting ink drops ejected by different printheads, inferring the positions and orientations of the printheads, and identifying correctional data useful for moving one or more of the printheads to achieve alignment acceptable for good registration in the printing system. The ink drops are ejected in a known pattern, sometimes called a test pattern, to enable one or more processors in the printing system to analyze image data of the test pattern on the ink receiving substrate for detection of the ink drops and determination of the printhead positions and orientation. In some inkjet printing systems, printheads are configured to eject a clear ink onto the ink receiving member. This clear ink is useful for adjusting gloss levels of the final printed product and to provide a protective layer over printed areas, if desired. One issue that arises from the use of clear ink, however, is the difficulty in detecting drops of clear ink ejected onto an ink receiving member with an imaging system. Because the clear inks do not image well, the known systems and methods for aligning printheads do not enable the clear ink drops to be detected and the positions and orientations of the printheads ejecting clear ink to be inferred. Therefore, development of a system and method for aligning printheads that eject clear ink is a desirable goal.

SUMMARY

A method of operating an inkjet printing system enables printheads that eject clear ink to be aligned with printheads that eject visibly colored ink. The method includes printing a first test pattern with ink having a first color on recording media as the recording media moves in a process direction past at least one printhead that ejects the ink having the first color, printing a second test pattern with clear ink on the recording media as the recording media moves in the process direction past at least one printhead that ejects the clear ink, the second test pattern being printed over the first test pattern, receiving data identifying a distance indicative of a misalignment of the at least one printhead that ejects the clear ink, the distance corresponding to a position of a portion of the second test pattern on the recording media, and operating with a controller at least one actuator operatively connected to the at least one printhead that ejects clear ink, the controller operating the at least one actuator with reference to the misalignment identifying data to adjust alignment of the at least one printhead that ejects clear ink with reference to the at least one printhead that eject the ink having the first color.

An inkjet printer is configured to enable printheads in the system that eject clear ink to be aligned with printheads that eject visibly colored ink. The system includes at least one printhead having an array of inkjets from which ink having a first color is ejected, at least one printhead having an array of inkjets from which clear ink is ejected, a user interface through which data is entered for processing within the inkjet printer, at least one actuator operatively connected to the at least one printhead that ejects clear ink, and a controller operatively connect to the at least one printhead that ejects ink having the first color, the at least one printhead that ejects clear ink, the at least one actuator, and the user interface, the controller being configured to operate the at least one printhead that ejects ink having the first color to print a first test pattern with ink having the first color on recording media moving in a process direction past the at least one printhead that ejects the ink having the first color, to operate the at least one printhead that ejects clear ink to print a second test pattern with clear ink on the recording media as the recording media moves in the process direction past at least one printhead that ejects the clear ink, the controller operating the at least one printhead that ejects clear ink to print the second test pattern over the first test pattern, to receive from the user interface data identifying a distance indicative of a misalignment of the at least one printhead that ejects the clear ink, the distance corresponding to a position of a portion of the second test pattern on the recording media, and to operate the at least one actuator operatively connected to the at least one printhead that ejects clear ink, the controller operating the at least one actuator with reference to the misalignment identifying data to adjust alignment of the at least one printhead that ejects clear ink with reference to the at least one printhead that eject the ink having the first color.

BRIEF DESCRIPTION OF THE DRAWINGS

An exemplary embodiment of this application will now be described, by way of example, with reference to the accompanying drawings, in which like reference numerals refer to like elements, and in which.

DETAILED DESCRIPTION

Figure 9:
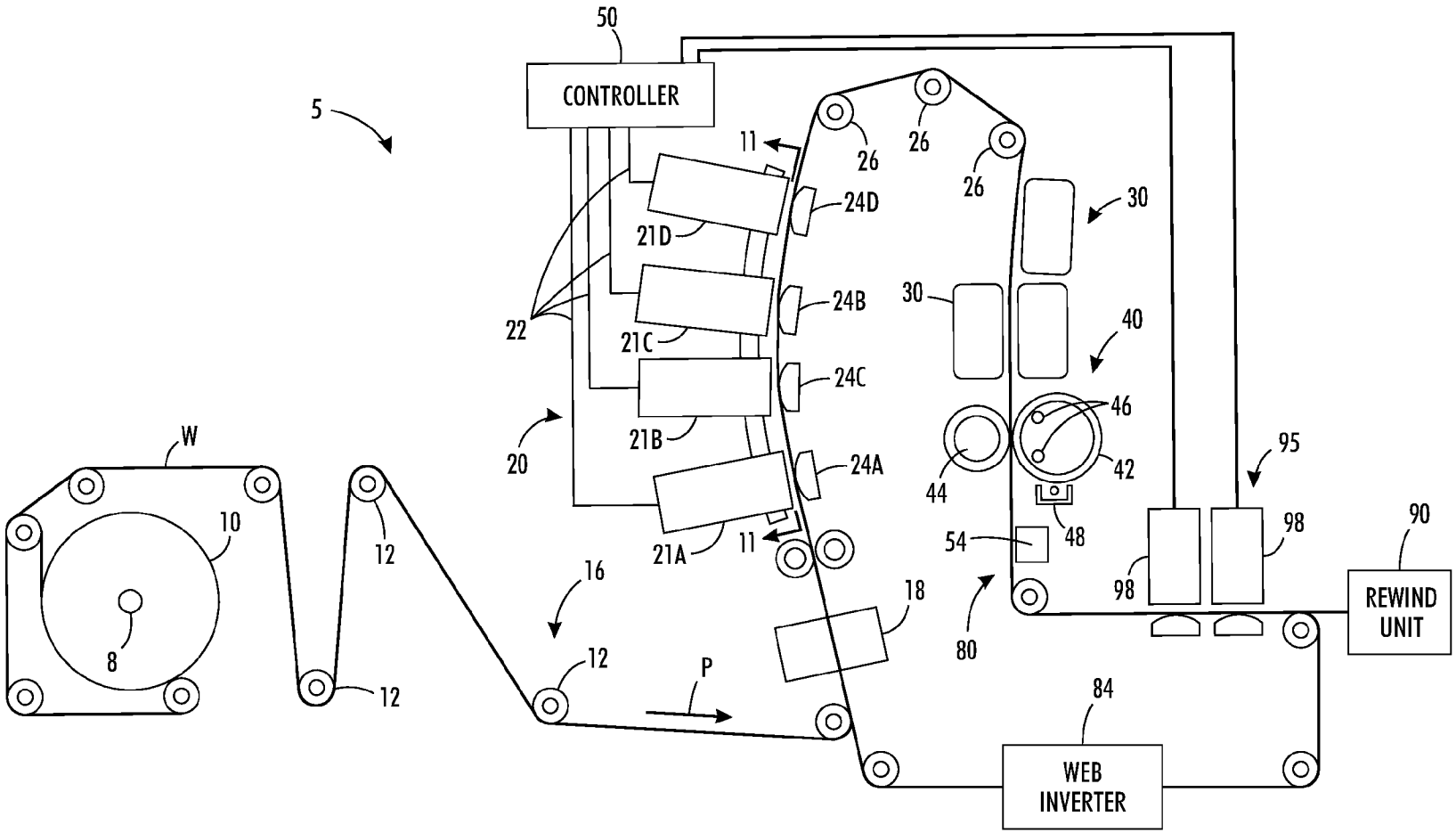
FIG. 9 is a schematic view of an improved inkjet imaging system that ejects ink onto a continuous web of media as the media moves past the printheads in the system.

Referring to FIG. 9, an inkjet imaging system 5 is shown. For the purposes of this disclosure, the imaging apparatus is in the form of an inkjet printer that employs one or more inkjet printheads and an associated solid ink supply. The controller, discussed in more detail below, may be configured to operate printheads in the system to print patterns with colored and clear inks that enable printheads that eject clear ink to be aligned. The processes described herein are applicable to any of a variety of other imaging apparatus that use inkjets to eject one or more colorants and clear ink to a medium or media. For example, while the system and method described below are particularly directed to a direct to media printing system, the system and method may be adapted to indirect printers that form an ink image on a rotating image member and then transfer the ink image from the image member to media. As used in this document, "clear ink" means any substantially clear or colorless material applied to media for any purpose, including but not limited to: forming a protective coating on any part of an image; obtaining a desired gloss level on any part of an image; forming security marks on the media surface; pre-treating any portion of the media surface prior to printing; or acting as a primer or adhesive on the media surface for any purpose.

The imaging apparatus 5 includes a print engine to process the image data before generating the control signals for the inkjet ejectors. The colorant may be ink, or any suitable substance that includes one or more dyes or pigments and that may be applied to the selected media. The colorant may be black, or any other desired color, and a given imaging apparatus may be capable of applying a plurality of distinct colorants as well as clear ink to the media. The media may include any of a variety of substrates, including plain paper, coated paper, glossy paper, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip the web over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 21D, each color unit effectively extending across the width of the media and being able to place ink directly (i.e., without use of an intermediate or offset member) onto the moving media. The arrangement of printheads in the print zone of system 5 is discussed in more detail with reference to FIG. 11. As is generally familiar, each of the printheads may eject a single color of ink, one for each of the colors typically used in color printing, namely, cyan, magenta, yellow, and black (CMYK).

In the system shown in FIG. 9, a coating station 95 that ejects clear ink follows the color unit that ejects black ink in the process direction. The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 ejects clear ink from a printhead 98 in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

The controller 50 of the printing system 5 receives velocity data from encoders mounted proximately to rollers positioned on either side of the portion of the path opposite the four color units and the coating station to calculate the linear velocity and position of the web as moves past the printheads. The controller 50 uses these data to generate timing signals for actuating the inkjet ejectors in the printheads to enable the four colors to be ejected with a reliable degree of accuracy for registration of the differently colored patterns to form four primary-color images on the media. The inkjet ejectors actuated by the firing signals correspond to image data processed by the controller 50. The image data may be transmitted to the printer, generated by a scanner (not shown) that is a component of the printer, or otherwise generated and delivered to the printer. In various possible embodiments, a color unit for each primary color and the coating station may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction P, such as for spot-color applications and the like.

Each of color units 21A-21D and the coating station 95 includes at least one actuator configured to adjust the printheads in each of the printhead modules in the cross-process direction across the media web. In a typical embodiment, each motor is an electromechanical device such as a stepper motor or the like. One embodiment illustrating a configuration of print bars, printheads, and actuators is discussed below with reference to FIG. 10. In a practical embodiment, a print bar actuator is connected to a print bar containing two or more printheads. The print bar actuator is configured to reposition the print bar by sliding the print bar along the cross-process axis of the media web. Printhead actuators may also be connected to individual printheads within each of color units 21A-21D and the coating station 95. These printhead actuators are configured to reposition an individual printhead by sliding the printhead along the cross-process axis of the media web. In this specific embodiment the printhead actuators are devices that physically move the printheads in the cross process direction. In alternative embodiments, an actuator system may be used that does not physically move the printheads, but redirects the image data to different ejectors in each head to change head position. Such an actuator system, however, can only reposition the printhead in increments that correspond to ejector to ejector spacing in the cross process direction.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Associated with each color unit and the coating station is a backing member 24A-24F, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the color units, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the color units. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to −10° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 9, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roller can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks, such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the processes for identifying malfunctioning inkjets and operating neighboring inkjets to compensate for the loss of the malfunctioning inkjets. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively coupled to the print bar and printhead actuators of color units 21A-21D and coating station 95 in order to adjust the position of the print bars and printheads in the cross-process direction.

The imaging system 5 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors. The LEDs of the light source may be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 11:
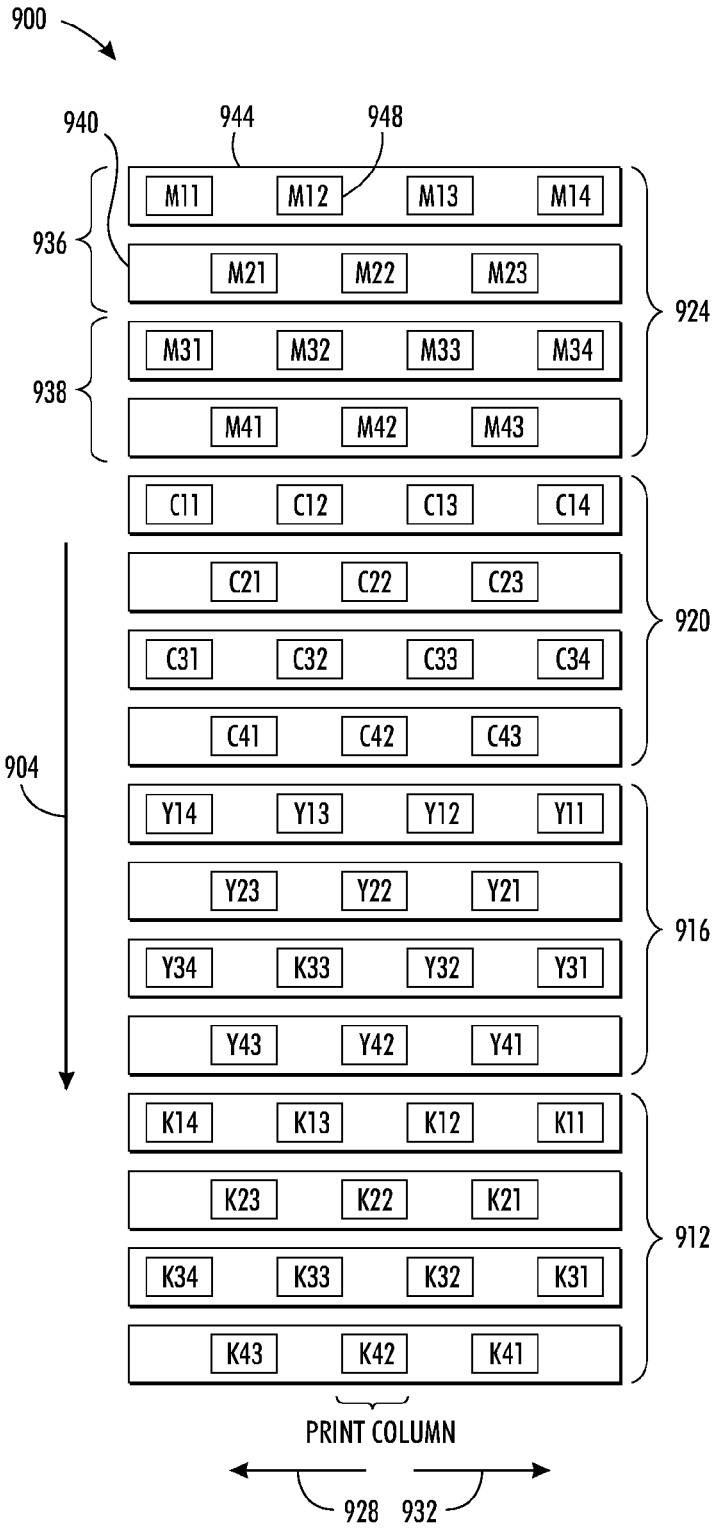
FIG. 11 PRIOR ART
FIG. 11 is a schematic view of a prior art printhead configuration viewed along lines 11-11 in FIG. 9.

A schematic view of a print zone 900 that may be aligned using known processes is depicted in FIG. 11. The print zone 900 includes four color units 912, 916, 920, and 924 arranged along a process direction 904. The coating station 926 follows the color unit 912. Each color unit ejects ink of a color that is different than the other color units, while the coating station ejects clear ink. In one embodiment, color unit 912 ejects black ink, color unit 916 ejects yellow ink, color unit 920 ejects cyan ink, and color unit 924 ejects magenta ink. Process direction 904 is the direction that an image receiving member moves as the member travels under the color units from color unit 924 to color unit 912. Each color unit and coating station includes two print bar arrays, each of which includes two print bars that carry multiple printheads. For example, the print bar array 936 of magenta color unit 924 includes two print bars 940 and 944. Each print bar carries a plurality of printheads, as exemplified by printhead 948. Print bar 940 has three printheads, while print bar 944 has four printheads, but alternative print bars may employ a greater or lesser number of printheads. The printheads on the print bars within a print array, such as the printheads on the print bars 940 and 944, are staggered to provide printing across the image receiving member in the cross process direction at a first resolution. The printheads on the print bars of the print bar array 936 within color unit 924 are interlaced with reference to the printheads in the print bar array 938 to enable printing of the colored ink across the image receiving member in the cross process direction at a second resolution. The print bars and print bar arrays of each color unit and the coating station are arranged in this manner. One print bar array in each color unit and the coating station is aligned with one of the print bar arrays in each of the other color units. The other print bar arrays in the color units and the coating station are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer. The coating station ejects ink onto colored ink drops to provide a protective coating or the clear ink is ejected onto bare media to alter the gloss of the media.

Figure 10:
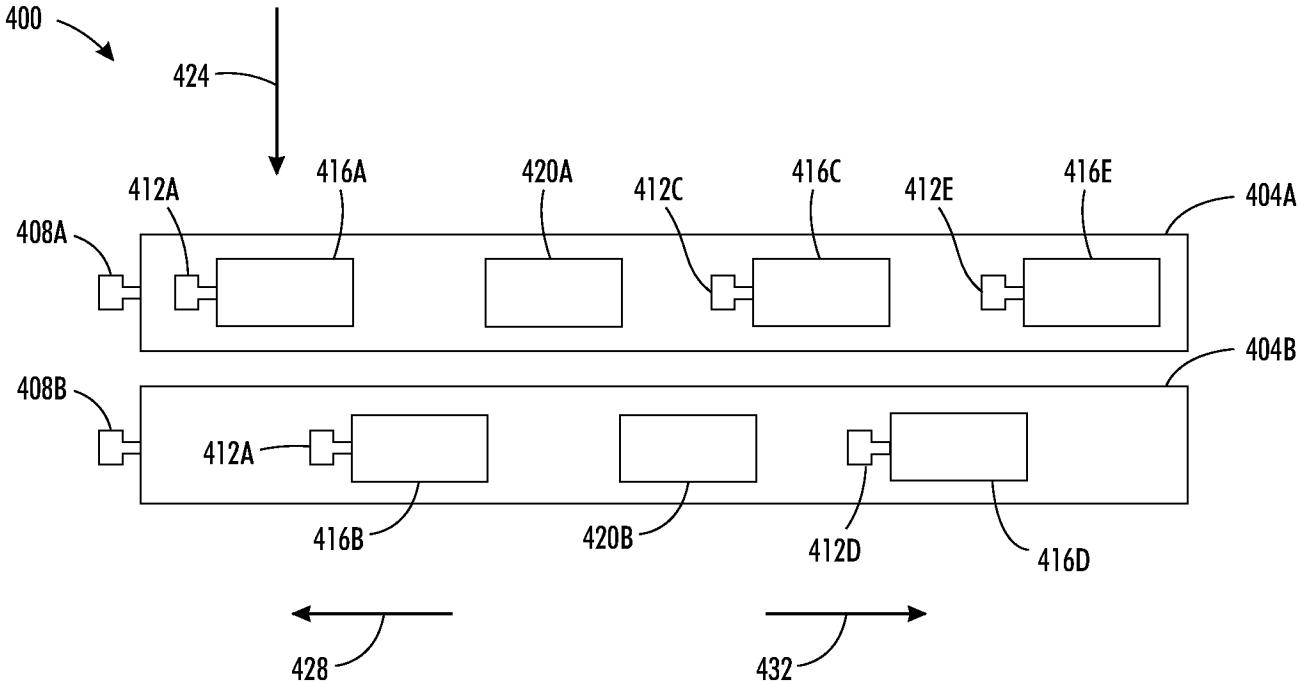
FIG. 10 PRIOR ART
FIG. 10 is a schematic view of a print bar unit.

FIG. 10 depicts a configuration for a pair of print bars that may be used in a color unit or coating station of the system 5. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. As used in this document, a "print bar array" refers to the printheads mounted to two adjacent print bars in the process direction that eject the same color of ink. Movement of a print bar causes all of the printheads mounted on the print bar to move an equal distance. Each of printhead motors 412A-412E moves an individual printhead in either of the cross-process directions 428 or 432. Motors 408A-408B and 412A-412D are electromechanical stepper motors capable of rotating a shaft, for example shaft 414, in a series of one or more discrete steps. Each step rotates the shaft a predetermined angular distance and the motors may rotate in either a clockwise or counterclockwise direction. The rotating shafts turn drive screws that translate print bars 404A-404B and printheads 416A-416E along the cross-process directions 428 and 432.

While the print bars of FIG. 10 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media. In such a print bar unit, an actuator may be operatively connected to the print bar or to the printhead. A process may be used to position such a wide printhead with respect to multiple printheads mounted to a single print bar or to other equally wide printheads mounted to other print bars. The actuators in such a system enable the inkjet ejectors of one printhead to be interlaced or aligned with the inkjet ejectors of another printhead in the process direction.

A method of printing test patterns with at least one color unit and the coating station in the printing system described above enables a printing system operator to evaluate alignment of the coating station printheads and to enter data into a system that operates actuators to adjust the position of the printheads in the coating station. The method requires a test pattern printed with the clear ink to be printed over a test pattern printed with a visibly colored ink. The clear ink changes the appearance of the portions of the uniformly colored ink areas that the clear ink overlies. The difference in appearance between the uncovered colored ink areas and the clear ink covered colored ink areas is enhanced by viewing the printed test patterns under specular light. Additionally, spreading the ink of the test patterns after test pattern printing and before test pattern viewing also aids in the detection of clear ink over colored ink areas. The test patterns for the colored ink and clear ink are configured in one embodiment to enable the area corresponding to the best alignment between the one or more printheads that eject the colored ink and the one or more printheads that eject the clear ink to identify a misalignment distance. This misalignment distance is then entered by the operator into the inkjet printer through a user interface and a controller within the printer operates one or more actuators operatively connected to the one or more printheads that eject clear ink to realign the printheads. The test patterns are configured in different arrangements of printed symbols or marks having a predetermined shape to identify misalignment in the process, cross-process, and roll directions.

Figure 2:
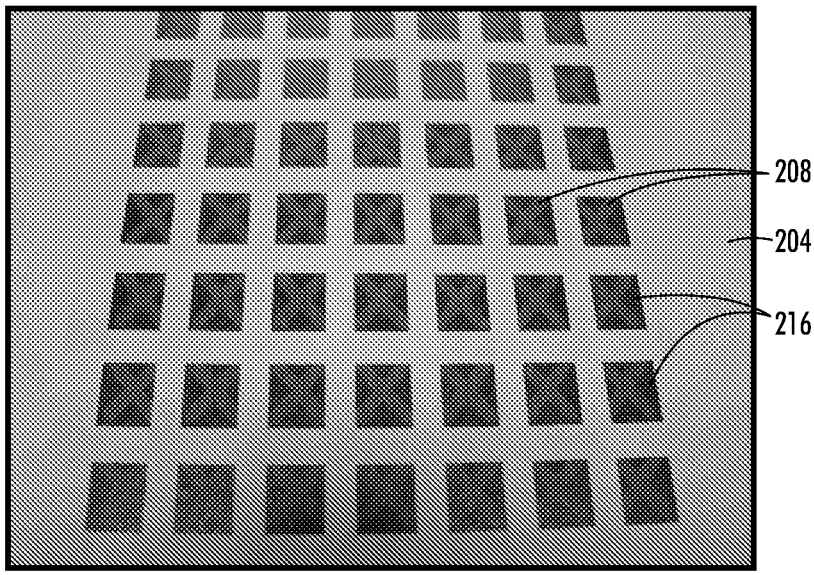
FIG. 2 is a depiction of clear ink on colored ink.
Figure 3:
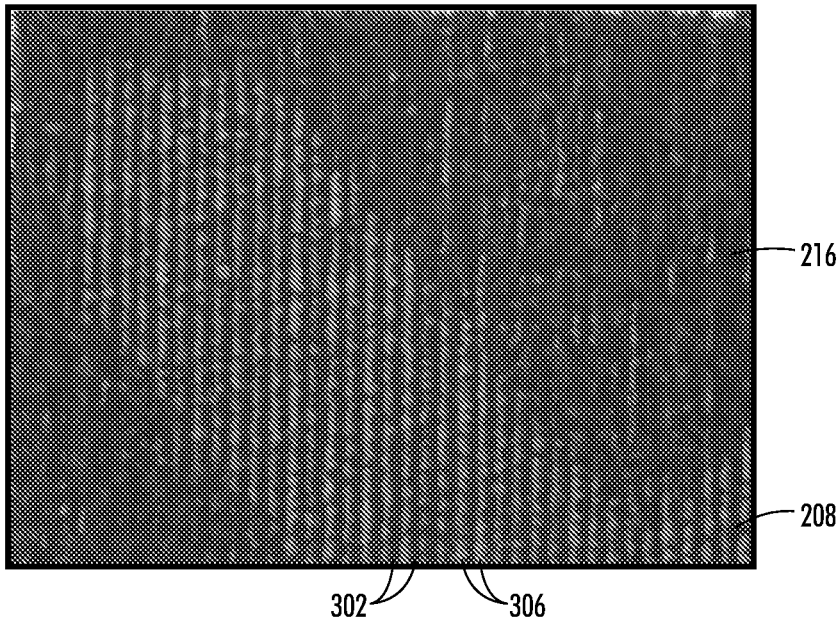
FIG. 3 is an enlargement of a portion of FIG. 2 illustrating the structure of clear ink and colored ink that enables the clear ink to be viewed.

The ability to see clear ink when printed over colored ink is illustrated in FIG. 2. The surface of the substrate 204 is shown tilted at an angle because the smooth surfaces of the clear ink in the X's 208 reflect light specularly, while the uncovered surface of the paper 212 and the colored ink areas 216 diffuse the light. By viewing the substrate at the angle of reflection that is equal to the angle of incidence for the illumination light, the clear ink covered areas are rendered more visible. FIG. 3 depicts the physical structure that further enhances the contrast of areas covered with clear ink in FIG. 2. A portion of one of the X's 208 is shown within an area of colored ink 216. The underlying colored ink was printed in columns at a high density. The controller operating the inkjets in the printheads ejecting the clear ink was configured to print over a portion of the colored ink area so the drops of clear ink were deposited on or very close to the drops of colored ink. In one embodiment, the controller is configured to eject the clear ink into the interstitial spaces of the colored ink area. After the area traveled through the roller nip in the spreader discussed above, the colored ink was spread by the pressure and covered the media adjacent a column of ink drops. In the area where the clear ink was printed, however, the clear ink tends to fill the area between the columns of colored ink. Because the spreading of the colored ink is inhibited in those areas by the clear ink, the columns of colored ink 302 are isolated from one another by the columns of media covered by clear ink 306. Thus, the media remains visible in the columns 306 so these areas are lighter than the areas in which the colored ink was able to spread. As noted above, printheads that eject the same color of ink can be offset from one another by a distance of about one-half of the nozzle separation distance in the cross-process direction to double the resolution in the cross-process direction. If only one of the printheads is operated to print the colored ink areas, then the distance between the columns of colored ink is increased to enhance the perceptibility of the media areas covered by clear ink. In other embodiments, the inkjets operated to produce the colored ink areas are selected to produce a uniform area at a resolution that is less than the possible resolution of the printhead to provide wider gaps between the columns of colored ink.

Figure 4:
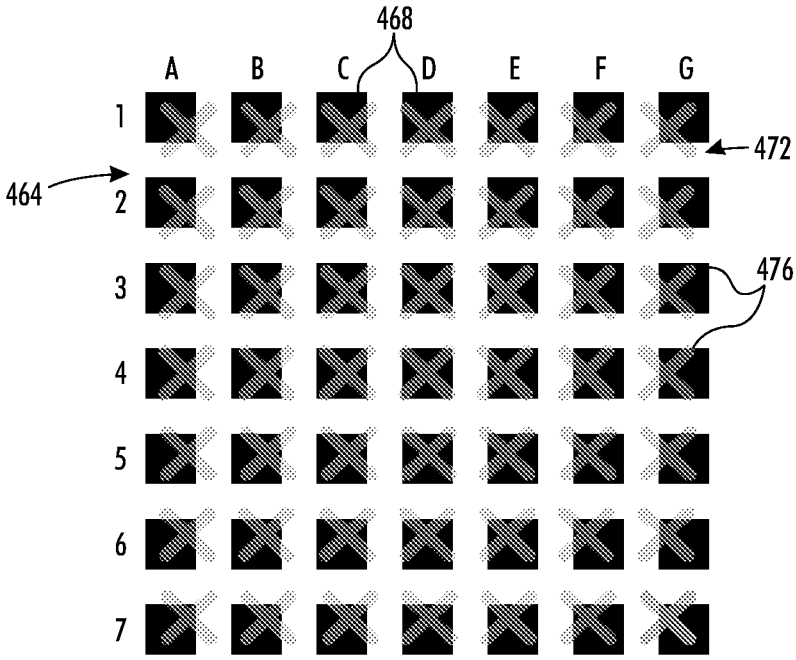
FIG. 4 depicts a clear ink test pattern over a colored ink test pattern that is used to identify misalignment in the process and cross-process directions.

One embodiment of the two test patterns used to detect misalignment in the printheads that eject clear ink is shown in FIG. 4. The first test pattern 404 is a seven by seven matrix of squares 408 printed in a single visible color of ink. The rows have been denoted with numbers and the columns are identified with letters. The second test pattern 412 is a seven by seven matrix of cruciform marks or X's 416 printed in the clear ink. Other symbols can be used in the test patterns provided the symbols of the first test pattern are capable of being distinguished from the symbols in the second test pattern. Likewise, the number of symbols within the test patterns in the process and cross-process directions is different in other embodiments, but the number of symbols is limited by the minimum size of the symbol that is visible as well as the width of the printhead. The centers of the X's are separated from one another in the process direction and in the cross-process direction by a predetermined number of pixels. Likewise, the centers of the squares are separated from one another in the process direction and the cross-process direction by a predetermined number of pixels that is different than the predetermined number of pixels separating the symbols in the first test pattern. By printing the two test patterns so the center of the centermost symbol in the second test pattern is positioned atop the center of the centermost symbol in the first test pattern as shown in FIG. 4, misalignment between the centers of the symbols in the first test pattern and the centers of the symbols in the second test pattern become progressively worse as the distance from the centermost symbol increases. The centering of the X and the square at the center of the two test patterns located at row 4, column D indicates the one or more printheads that eject the clear ink are aligned with the one or more printheads that eject the colored ink.

Figure 5:
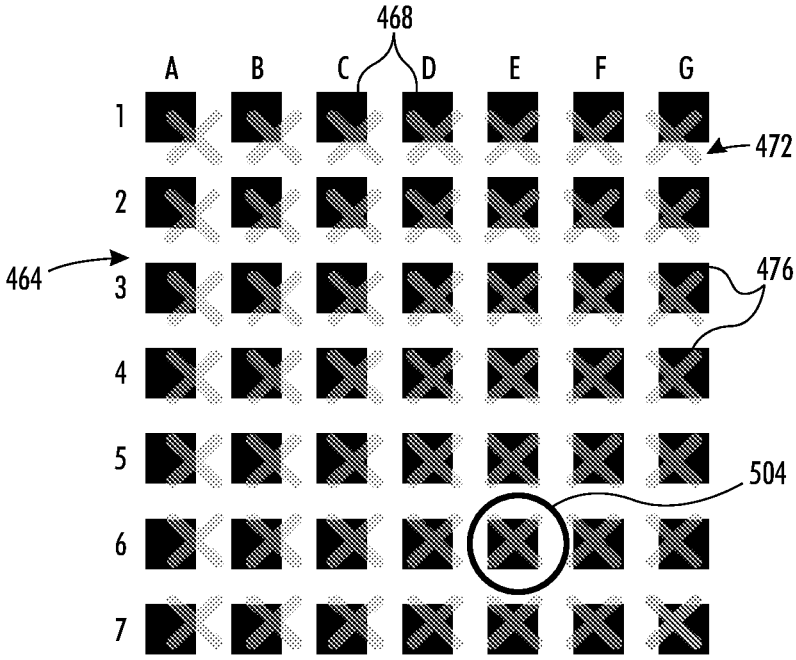
FIG. 5 is a depiction of the test patterns in FIG. 4 indicating printhead misalignment.

If one or more of the printheads that eject clear ink are not properly aligned with the one or more printheads that eject colored ink, then a symbol of the first test pattern and a symbol of the second test pattern other than the two centermost symbols as shown in FIG. 4 align. FIG. 5 is an illustration of the first and second test patterns of FIG. 4 depicting a misalignment in this manner. As shown in FIG. 5, the X of the second test pattern and the square of the first test pattern are aligned at the row 6, column E position 504. In this depicted embodiment, the spacing between the centers of the symbols in the second test pattern are five pixels shorter than the spacing between the centers of the symbols in the first test pattern. Consequently, the centering of the two test patterns at E6 indicates the one or more printheads that eject clear ink are misaligned by a distance that is five pixels to the right of the intended center in the cross-process direction and by a distance that is ten pixels below the intended center in the process direction. After an operator viewing the media printed out with the two test patterns on it determines the row and column position at which the two patterns are most centered, the identifying information is entered into the inkjet printer through a user interface. A controller then operates one or more actuators operatively connected to the one or more printheads that eject clear ink with reference to this identifying data to align the printheads.

Varying the spacing distance between the centers of the two test patterns enables different resolutions of accurate alignment to be checked. For example, separating the centers of the X's in the second test pattern from the centers of the squares in the first test pattern by a larger distance, such as thirty one pixels, for example, enables a misalignment as large as ±93 pixels in the process and cross-process directions to be identified. Consequently, a pair of test patterns separated by such a large difference enable the alignment between the one or more the printheads that eject clear ink and the one or more printheads that eject colored ink to be adjusted to a distance that is approximately one half of the distance separating the centers. For example, the test patterns separated by the thirty one pixel distance enable the alignment to be adjusted to a level corresponding to about fifteen and one half pixels. The alignment between the one or more printheads that eject clear ink and the one or more printheads that eject colored ink can be then be further adjusted more precisely by printing the two test patterns with more closely spaced centers. For example, using the five pixel separated patterns after use of the thirty one pixel separated patterns and corresponding adjustment enables the alignment between the one or more the printheads that eject clear ink and the one or more printheads that eject colored ink to reach the level of about two and one half pixels. Consequently, two or more pairs of test patterns having different center spacings are used to adjust misalignment of the printheads that eject clear ink from an initially large misalignment to a smaller misalignment.

Figure 6:
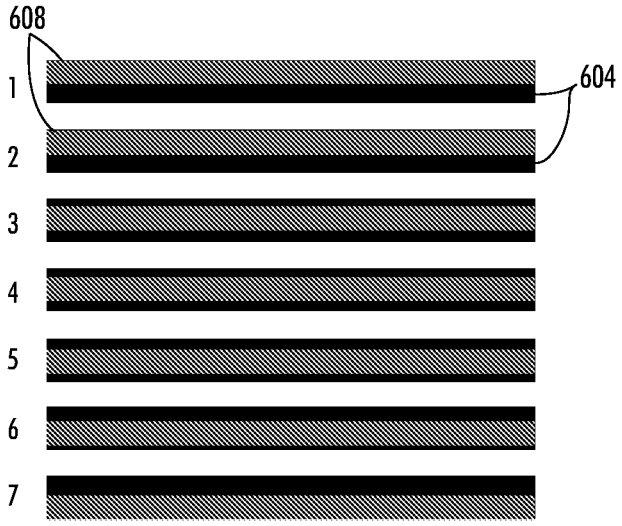
FIG. 6 depicts a clear ink test pattern over a colored ink test pattern that is used to identify roll misalignment for a printhead.

Another alignment parameter for printheads is roll alignment. Roll refers to rotation of a printhead about an axis that is perpendicular to the plane of the media. One embodiment of a pair of test patterns used to detect and correct roll misalignment is shown in FIG. 6. In that illustration, seven colored ink rectangles 604 of the first test pattern are printed by one or more printheads that have been previously aligned by known methods. Seven clear ink rectangles 608 are then printed by one or more printheads that eject clear ink. If the roll of the printheads that eject clear ink match the roll of the printheads that eject colored ink, then the center of the clear ink rectangle in row 4 bisects the center of the colored ink rectangle in row 4. Because the spacing between one edge of a clear ink rectangle and the edge of the next clear ink rectangle in the process direction is one pixel longer than the spacing between the edges of the colored ink rectangles in the process direction of the sequence, the clear ink rectangle in row 3 and row 5 is displaced from the center of the colored ink rectangle in row 3 and row 5 by one pixel towards the top of the page and the bottom of the page, respectively. Because the colored ink rectangles are configured to be six pixels wider in the process direction than the width of the clear ink rectangles in the process direction, three pixels of colored ink separate the bottom edge of the clear ink rectangle from the bottom edge of the colored ink rectangle in row 4. Likewise, three pixels of colored ink separate the top edge of the clear ink rectangle from the top edge of the colored ink rectangle in row 4. Thus, the printing of the second test pattern of clear ink rectangles over the first test pattern of colored ink rectangles results in the bottom edge of the clear ink rectangle in row 7 to be aligned with the bottom edge of the colored ink rectangle in row 7, while the top edge of the clear ink rectangle in row 1 is aligned with the top edge of the colored ink rectangle in row 1.

Figure 7:
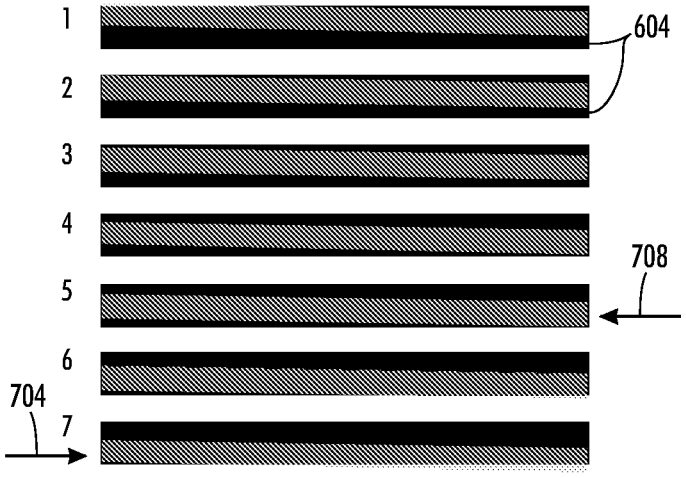
FIG. 7 is a depiction of the test patterns in FIG. 6 indicating printhead roll misalignment.

In a situation in which a printhead that ejects clear ink has rolled, the clear ink rectangles are printed with a slant. This slant causes the bottom edge of one of the clear ink rectangles to align with the bottom edge of a first colored rectangle on the left side of the two patterns while causing the bottom edge of another one of the clear ink rectangles to align with the bottom edge of a second colored rectangle on the right side of the two patterns. For example, FIG. 7 shows that the bottom edge of the clear ink rectangle of row 7 aligns with the bottom edge of the colored ink rectangle of row 7 at the left side of the two test patterns at position 704, but the bottom edge of that clear ink rectangle extends below the right hand bottom edge of the colored rectangle of row 7. Instead, the bottom edge of the clear ink rectangle in row 5 aligns with the bottom edge of the colored ink rectangle of row 5 at the right side at position 708, while the bottom edges of these two rectangles are separated at the left hand side of row 5. This difference in bottom edge alignment indicates the printhead that ejects clear ink has been rotated from the aligned position by an angle that corresponds to approximately two pixels divided by the width of the clear ink rectangle. The two row difference can be entered into the inkjet printer through the user interface and the controller can operate one or more actuators operatively connected to the rotated printhead that ejected the clear ink in the second test pattern to roll the printhead with reference to the two pixel difference and the width of the clear ink rectangle. The first and second test patterns can also be compared by looking for the rows where the left and right hand top edges of the clear ink and colored rectangles align. For example, in FIG. 7, the top edges in row 3 align on the left side of the patterns while the top edges in row 1 align on the right side.

Figure 8:
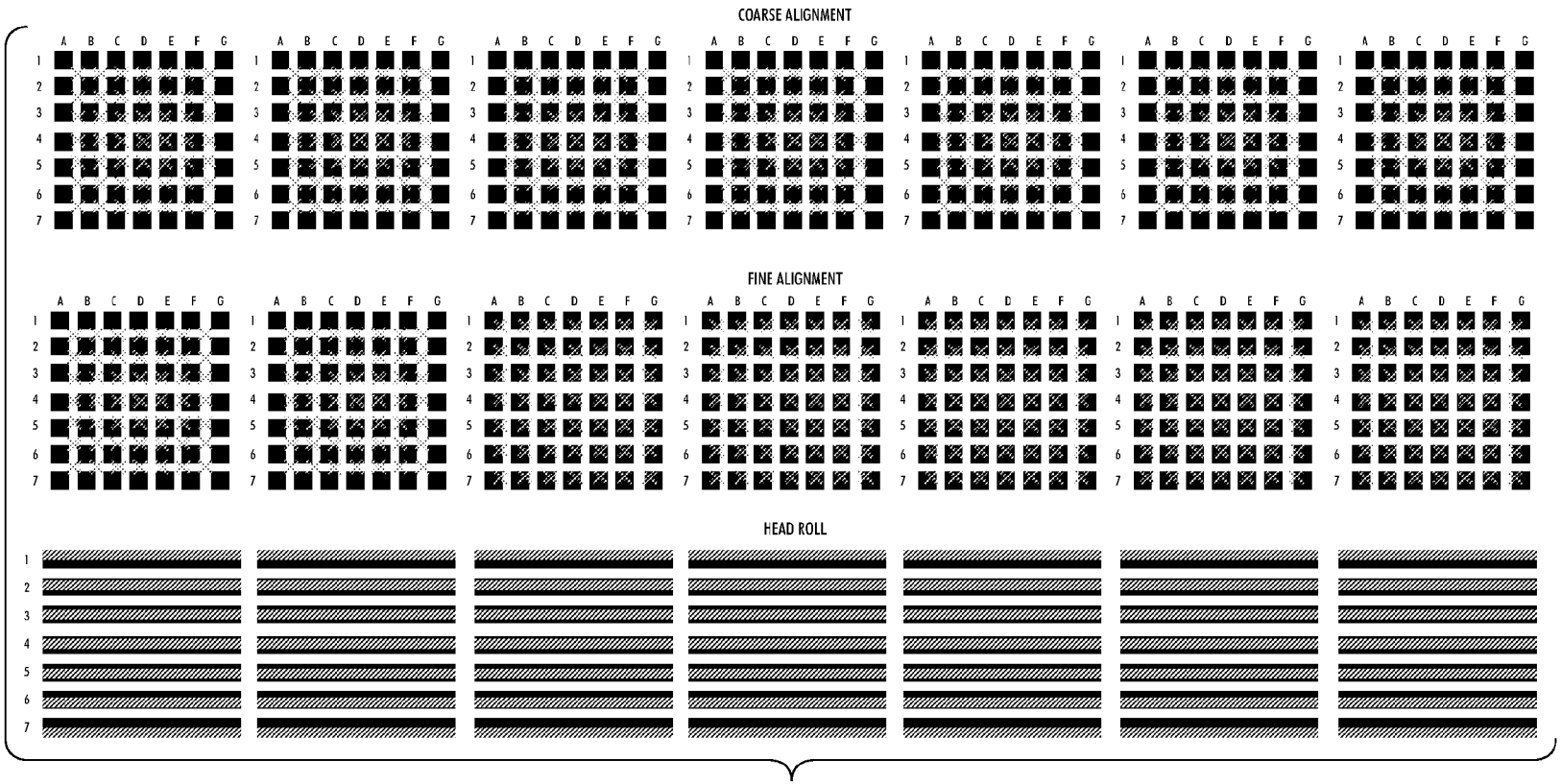
FIG. 8 is an illustration of three groups of test patterns that are used to identify coarse, fine, and roll misalignment for printheads that eject clear ink.

The test patterns shown in FIG. 8 are used in one embodiment to verify and adjust, if necessary, the alignment of printheads that eject clear ink. Prior to printing these groups of test patterns, the printheads that eject colored ink are aligned in a known manner to provide the reference to which the printheads that eject clear ink can be compared. The top group 804 of first and second test patterns corresponds to a configuration in which seven printheads span the media width and is similar to the one shown in FIG. 11. One configuration ejects colored ink and the other configuration ejects clear ink. The spacing between the symbols in the group 804 enables coarse registration of each printhead that ejects clear ink with one of the printheads that ejects colored ink. In a similar manner, a controller operates the printheads in the two configurations to print the first and second test patterns of the middle group 808. The spacing between the symbols in this group enables fine registration of each printhead that ejects clear ink with one of the printheads that ejects colored ink. The controller also operates the printheads in the two configurations to print the first and second test patterns of the bottom group 812. These patterns are used to identify any roll misalignment of the printheads that eject clear ink.

Figure 1:
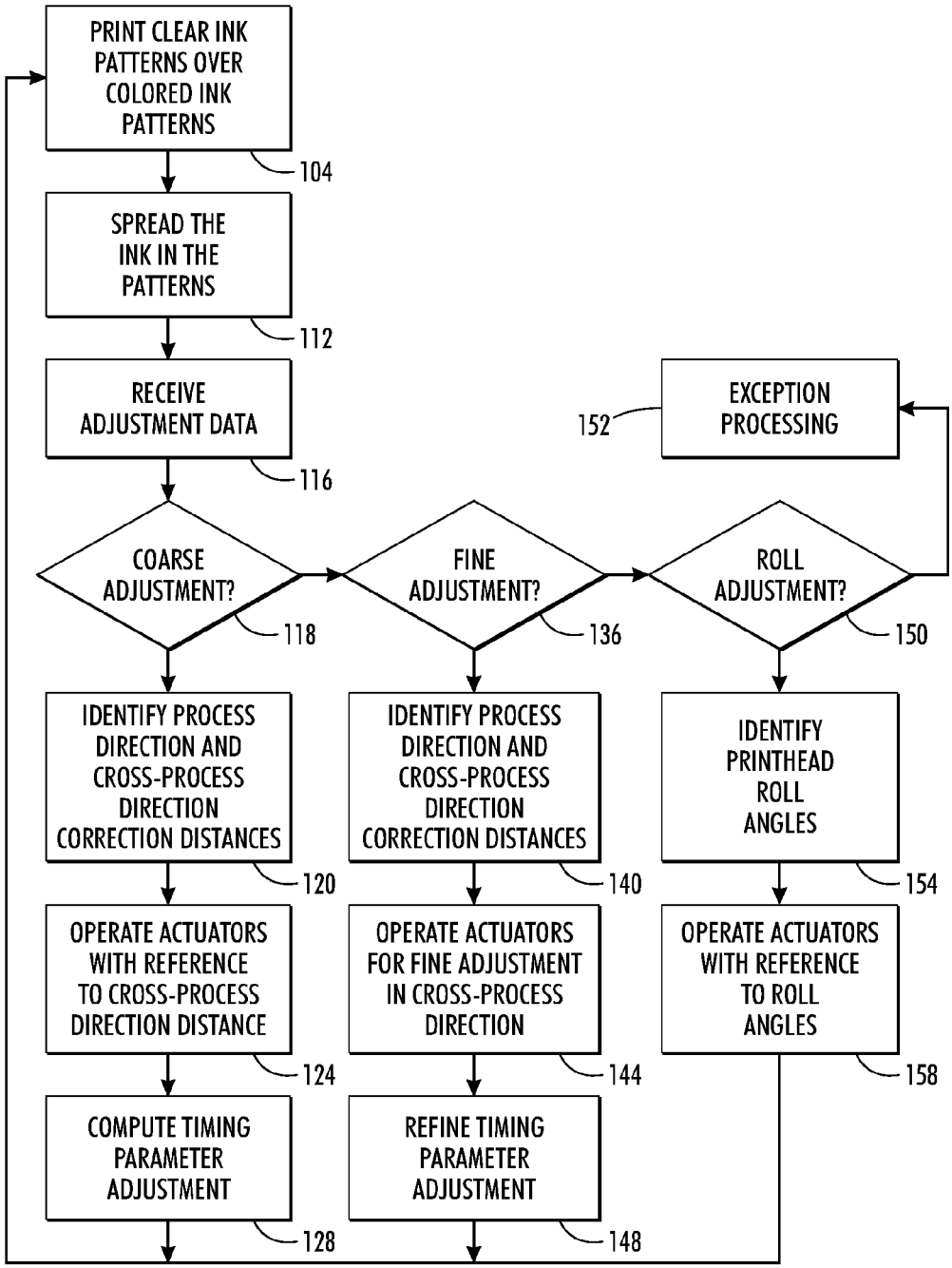
FIG. 1 is a flow diagram of a process that enables printheads that eject clear ink to be aligned with printheads that eject visibly colored ink.

A method 100 that enables printheads that eject clear ink to be aligned to printheads that eject colored ink in an inkjet printer is shown in FIG. 1. After the printheads that eject colored ink have been aligned using known methods, a controller in the inkjet printer operates one or more printheads that eject colored ink to print a first test pattern and then operates one or more printheads that eject clear ink to print a second test pattern over the first test pattern (block 104). In one embodiment, the operation of the printheads is performed to print the first test patterns of the three groups shown in FIG. 8 and then the clear ink printheads are operated to print the second test patterns over the first test patterns in the three groups. After the printed test patterns have passed through the nip in the spreader (block 112), the media on which the test patterns have been printed exit the inkjet printer and the operator observes the groups of test patterns with a light source illuminating the test pattern at a specular angle similar to the one shown in FIG. 2. The operator views the coarse registration group first and determines the position where the symbol of the second test pattern is best centered within a symbol in the first test pattern. If this position is not the center of each matrix in the coarse registration group, the operator enters data in the user interface of the inkjet printer that identifies the adjustment as a coarse adjustment along with the print column where this condition is not met and the row and column indices of the position where the centers of the first and the second test patterns coincide (block 116). The controller detects a coarse registration is occurring (block 118) and uses the print column identifier to identify the corresponding printhead that ejects clear ink that is not properly aligned and the spacing parameters for the coarse registration test patterns to identify the magnitude of the misalignment in the process direction and the cross-process direction (block 120). The cross-process direction distance is used by the controller to operate the one or more actuators operatively connected to the printhead corresponding to the identified matrix (block 124). The process direction distance is used by the controller to compute a time adjustment parameter that is subsequently used to retard or advance the application of the firing signal to the printhead to compensate for the process direction distance misalignment (block 128). The operator determines the row and column indices of the best aligned objects for each matrix in the test pattern, and the adjustments are then made.

Once the printheads are adjusted and the compensating time parameters computed and stored for later use, the test pattern groups are printed again (blocks 104-112). The operator views the coarse registration group again and determines if the centers of the two test patterns coincide. If they do not, the processing described above is repeated. This portion of the process is iteratively performed until the centers of the two test patterns for the coarse registration group coincides. Then the operator views the test patterns of the fine registration group and determines the position where the symbol of the second test pattern is best centered within a symbol in the first test pattern. If this position is not the center of each matrix in the fine registration group, the operator enters data in the user interface of the inkjet printer that identifies the adjustment as a fine adjustment along with each print column where this condition is not met and the row and column indices of the position where the centers of the first and the second test patterns coincide (block 116). The controller detects a fine adjustment is occurring (block 136) and uses the print column identifier to identify the corresponding printhead that ejects clear ink that is not properly aligned and the spacing parameters for the fine registration test patterns to identify the magnitude of the misalignment in the process direction and the cross-process direction (block 140). The cross-process direction distance is used by the controller to operate the one or more actuators operatively connected to the printhead corresponding to the identified matrix (block 144). Of course, these movements are finer than the ones performed in response to the data obtained with reference to the coarse registration pattern. The process direction distance is also used by the controller to further refine the computation of the time adjustment parameter that is subsequently used to retard or advance the application of the firing signal to the printhead to compensate for the process direction distance misalignment (block 148). The operator determines the row and column indices of the best aligned objects for each matrix in the test pattern, and the adjustments are then made. While the discussion above relates to a coarse registration and fine registration, further levels of adjustment could be provided, such as a superfine adjustment level with a test pattern having appropriately spaced objects for finer adjustments.

Once the printheads are adjusted and the compensating time parameters computed and stored for later use with reference to the fine registration group, the groups of test patterns are printed again (blocks 104-112). The operator views the fine registration group again and determines if the centers of the two test patterns coincide. If they do not, the processing described above for fine registration adjustment is repeated. This portion of the process is iteratively performed until the centers of the two test patterns for the fine registration group coincides. Then the operator views the test patterns for detecting roll misalignment and determines whether the bottom edge of the clear ink rectangle aligns with the bottom edge of the center colored ink rectangle on both the left and the right hand sides. If this alignment across the bottom edge of the center colored ink rectangle in each print column of the roll adjustment group is not found, the operator enters data in the user interface of the inkjet printer that identifies the adjustment as a roll adjustment along with the print column where this condition is not met and the difference in row numbers between the two rows where the bottom edge of the clear ink rectangle aligns with the bottom edge of the colored ink rectangle on the left and right hand sides (block 116). The controller detects a roll adjustment is occurring (block 150) and uses the matrix identifier to identify the corresponding printhead that ejects clear ink that is not properly oriented and identifies the angle of roll with reference to row difference and the spacing parameters of the rectangles used in the roll adjustment group (block 154). The identified angle is used by the controller to operate the one or more actuators operatively connected to the printhead for roll adjustment that corresponds to the identified print column (block 158). This roll adjustment is done for each print column identified by the operator using the data identifying the distance indicative of misalignment for the corresponding printhead. The process is performed until the printheads that eject clear ink have been aligned with the printheads that ejected the colored ink in the first test patterns.

In one embodiment, the roll adjustment is made with reference to a pivot position that sometimes causes process or cross-process translation of the printheads. In this embodiment, the process is re-initiated to enable an operator to view the coarse and fine registration groups again to determine where the previously obtained alignments of the clear ink printheads have been disturbed by the roll adjustment. If any of the prior adjustments has been disturbed the fine adjustment or coarse and fine adjustment portions of the process are performed again to establish the process and cross-process alignments of the printheads that eject clear ink.

The process described with reference to FIG. 1 is performed at the initiation of operation of the inkjet printer. After the process is finished, the printheads that eject clear ink are in registration with the printheads that ejected the colored ink for the first test patterns. Because the process that aligns these printheads that eject colored ink with the other printheads that eject ink in the inkjet printer is performed in situ, the printheads that eject clear ink can be adjusted with reference to any corrections used for the printheads that ejected the colored ink for the first test patterns. Updating the alignment of the clear ink ejecting printheads in this manner enables the inkjet printer to operate for longer periods of time without having to stop for printing of the clear ink registration test pattern groups. In one embodiment, the last group of printheads ejecting colored ink in the process direction before the clear ink ejecting printheads are encountered is the group that ejects black ink. Consequently, the printheads ejecting black ink are selected to print the first test patterns and subsequent alignment adjustments made to the printheads in that group are used to adjust the alignment of the corresponding printheads in the clear ink ejecting printhead group.

In operation, an inkjet printer is configured to implement the process described above. The controller of the inkjet printer operates a group of printheads that eject colored ink and a group of printheads that eject clear ink to print the groups of first and second test patterns described above. The operator views those test patterns and enters data into the inkjet printer through the user interface to enable the controller to operate actuators and compute timing parameters to adjust the alignment of the printheads that eject clear ink. Thereafter, any adjustment of the printheads that eject colored ink by an in situ process is also used to adjust the corresponding printheads that eject clear ink. Only if misregistration of the clear ink to the colored ink is perceived in a print run does the operator need to repeat the process for clear ink ejecting printhead alignment.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of aligning printheads that eject clear ink in an inkjet printer comprising:

printing a first test pattern with ink having a first color on recording media as the recording media moves in a process direction past at least one printhead that ejects the ink having the first color, the printing of the first test pattern including printing a plurality of rows of a first predetermined mark on the recording media with ink drops of the first color separated from one another by at least one pixel position in a cross-process direction;

printing a second test pattern with clear ink on the recording media as the recording media moves in the process direction past at least one printhead that ejects the clear ink, the second test pattern being printed over the first test pattern and the printing of the second test pattern including printing a plurality of rows of a second predetermined mark on the recording media with clear ink drops positioned between the ink drops of the first color, the second predetermined mark being different than the first predetermined mark;

receiving data identifying a distance indicative of a misalignment of the at least one printhead that ejects the clear ink, the distance corresponding to a position of a portion of the second test pattern on the recording media; and operating with a controller at least one actuator operatively connected to the at least one printhead that ejects clear ink, the controller operating the at least one actuator with reference to the misalignment identifying data to adjust alignment of the at least one printhead that ejects clear ink with reference to the at least one printhead that eject the ink having the first color.

2. The method of printhead alignment in claim 1 further comprising:

printing the plurality of rows of the first predetermined mark with a center of the first predetermined marks being separated by a first distance; and printing the plurality of rows of the second predetermined mark with a center of the second predetermined marks being separated by a second distance, the first distance being different than the second distance.

3. The method of printhead alignment in claim 1 wherein the first predetermined mark is substantially rectangular and the second predetermined mark is a cruciform.

4. The method of printhead alignment in claim 1 wherein the first predetermined marks in the plurality of rows also being arranged in a plurality of columns in the process direction; and the second predetermined marks in the plurality of rows also being arranged in a plurality of columns in the process direction.

5. The method of printhead alignment in claim 1 wherein the data identifies a distance indicative of at least one of a cross-process misalignment and a process direction misalignment.

6. The method of printhead alignment in claim 1, wherein the data identifies a distance indicative of a roll misalignment.

7. The method of printhead alignment in claim 1 further comprising:

spreading the first test pattern and the second test pattern on the recording media before the identifying data is received.

8. The method of printhead alignment in claim 1 further comprising:

printing with the ink having the first color a plurality of objects having a predetermined length in a cross-process direction, the objects printed in the ink having the first color being separated from each other by a predetermined distance in the process direction; and printing with the clear ink a plurality of objects having the predetermined length in the cross-process direction, the objects printed in the clear ink being separated from each other by a predetermined distance in the process direction that is different than the predetermined distance separating the objects printed in the ink having the first color.

9. The method of printhead alignment in claim 8 wherein the objects printed in the ink having the first color and the objects printed in the clear ink being rectangles and the rectangles printed in the clear ink are printed over the rectangles printed in the ink having the first color.

10. The method of printhead alignment in claim 1 wherein the clear ink of the second test pattern is printed within interstitial spaces in the first test pattern to enable specular reflection of light from the recording media.

11. An inkjet printer comprising:

at least one printhead having an array of inkjets from which ink having a first color is ejected;

at least one printhead having an array of inkjets from which clear ink is ejected;

a user interface through which data is entered for processing within the inkjet printer;

at least one actuator operatively connected to the at least one printhead that ejects clear ink; and a controller operatively connect to the at least one printhead that ejects ink having the first color, the at least one printhead that ejects clear ink, the at least one actuator, and the user interface, the controller being configured:

to operate the at least one printhead that ejects ink having the first color to print a first test pattern with ink having the first color on recording media moving in a process direction past the at least one printhead that ejects the ink having the first color, the first test pattern having a plurality of rows of a first predetermined mark on the recording media with ink drops of the first color separated from one another by at least one pixel position in a cross-process direction;

to operate the at least one printhead that ejects clear ink to print a second test pattern with clear ink on the recording media as the recording media moves in the process direction past at least one printhead that ejects the clear ink, the controller operating the at least one printhead that ejects clear ink to print the second test pattern over the first test pattern, the second test pattern having a plurality of rows of a second predetermined mark on the recording media with clear ink drops positioned between the ink drops of the first color, the second predetermined mark being different than the first predetermined mark; and to receive from the user interface data identifying a distance indicative of a misalignment of the at least one printhead that ejects the clear ink, the distance corresponding to a position of a portion of the second test pattern on the recording media, and to operate the at least one actuator operatively connected to the at least one printhead that ejects clear ink, the controller operating the at least one actuator with reference to the misalignment identifying data to adjust alignment of the at least one printhead that ejects clear ink with reference to the at least one printhead that ejects the ink having the first color.

12. The inkjet printer of claim 11, the controller being further configured to print the plurality of rows of the first predetermined mark with a center of the first predetermined marks being separated by a first distance and to print the plurality of rows of the second predetermined mark with a center of the second predetermined marks being separated by a second distance, the first distance being different than the second distance.

13. The inkjet printer of claim 11, the controller being further configured to print the first predetermined mark as substantially rectangular and the second predetermined mark as a cruciform.

14. The inkjet printer of claim 11, the controller being further configured to operate the at least one printhead that ejects ink having the first color to print the first predetermined marks in the plurality of rows in a plurality of columns in the process direction and to operate the at least one printhead that ejects clear ink to print the second predetermined marks in the plurality of rows in a plurality of columns in the process direction.

15. The inkjet printer of claim 11, the controller being further configured to print the first predetermined marks in the plurality of rows in a plurality of columns in the process direction and to print the second predetermined marks in the plurality of rows in a plurality of columns in the process direction.

16. The inkjet jet printer of claim 15, the controller being further configured to print the objects with the ink having the first color a plurality of objects with a predetermined length in a cross-process direction, the objects printed in the ink having the first color being separated from each other by a predetermined distance in the process direction and to print the objects with the clear ink a plurality of objects with the predetermined length in the cross-process direction, the objects printed in the clear ink being separated from each other by a predetermined distance in the process direction that is different than the predetermined distance separating the objects printed in the ink having the first color.

17. The inkjet printer of claim 16, the controller being further configured to print the objects in the ink having the first color and the objects in the clear ink as rectangles and to print the rectangles printed in the clear ink over the rectangles printed in the ink having the first color.

18. The inkjet printer of claim 11 wherein the controller is further configured to operate the at least one actuator with reference to the data that identifies the distance indicative of misalignment to move the at least one printhead that ejects clear ink in at least one of a cross-process direction and a process direction.

19. The inkjet printer of claim 11, wherein the controller is further configured to operate the at least one actuator with reference to the data that identifies the distance indicative of misalignment to move the at least one printhead that ejects clear ink in one of a clockwise rotational direction and a counterclockwise rotational direction.

20. The inkjet printer of claim 11 further comprising:

a spreader positioned from the at least one printhead that ejects the ink having the first ink color and the at least one printhead that ejects the clear ink in the process direction, the spreader being configured to spread the ink having the first color and the clear ink on the recording media before the identifying data is received.

21. The inkjet printer of claim 11, the controller being further configured to eject the clear ink of the second test pattern within interstitial spaces in the first test pattern to enable specular reflection of light from the recording media.

* * * * *